United States Patent [19]

Levine

[11] 4,028,702

[45] June 7, 1977

[54] FIBER OPTIC PHASED ARRAY ANTENNA SYSTEM FOR RF TRANSMISSION

[75] Inventor: Arnold M. Levine, Chatsworth, Calif.

[73] Assignee: International Telephone and Telegraph Corporation, New York, N.Y.

[22] Filed: July 21, 1975

[21] Appl. No.: 597,417

[52] U.S. Cl. ..... 343/100 SA; 343/854

[51] Int. Cl.² ..... H01Q 3/26

[58] Field of Search ..... 343/100 SA, 854

[56] References Cited

UNITED STATES PATENTS 3,878,520 4/1975 Wright et al. ..... 343/100 SA

*Primary Examiner*—Maynard R. Wilbur

*Assistant Examiner*—Richard E. Berger

*Attorney, Agent, or Firm*—William T. O'Neil

[57] ABSTRACT

A system for providing the plural variable phase RF signals required to control the beam pointing angle of a phased array. A light energy source (shown as a laser generator) is modulated by an RF signal and fed to a plurality of channels in parallel. Each of the said channels corresponds to one radiating element of the phased array and each channel includes as many selectively employed fiber optic delay lines of different lengths as are required to generate the discrete phases required at the corresponding antenna (radiator) element of the array. A commutating programmer controls the selection of individual radiating element phases for each successive beam pointing position.

9 Claims, 5 Drawing Figures

FIG. 3.
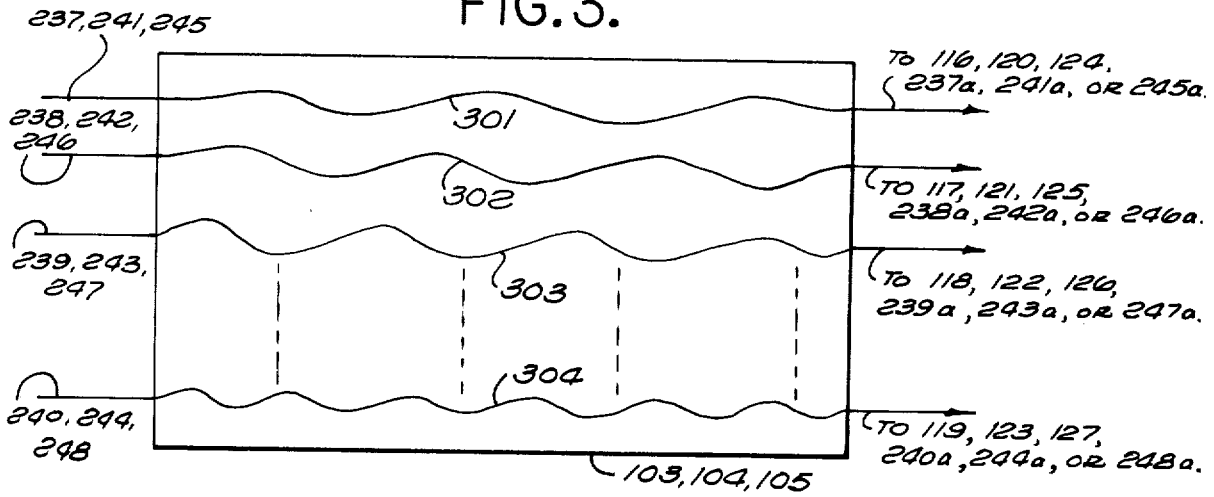
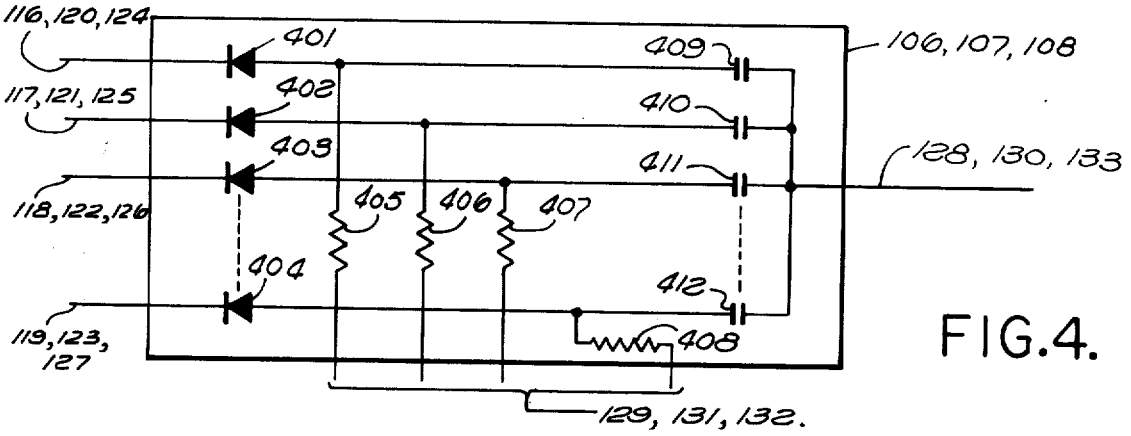
FIG. 4.
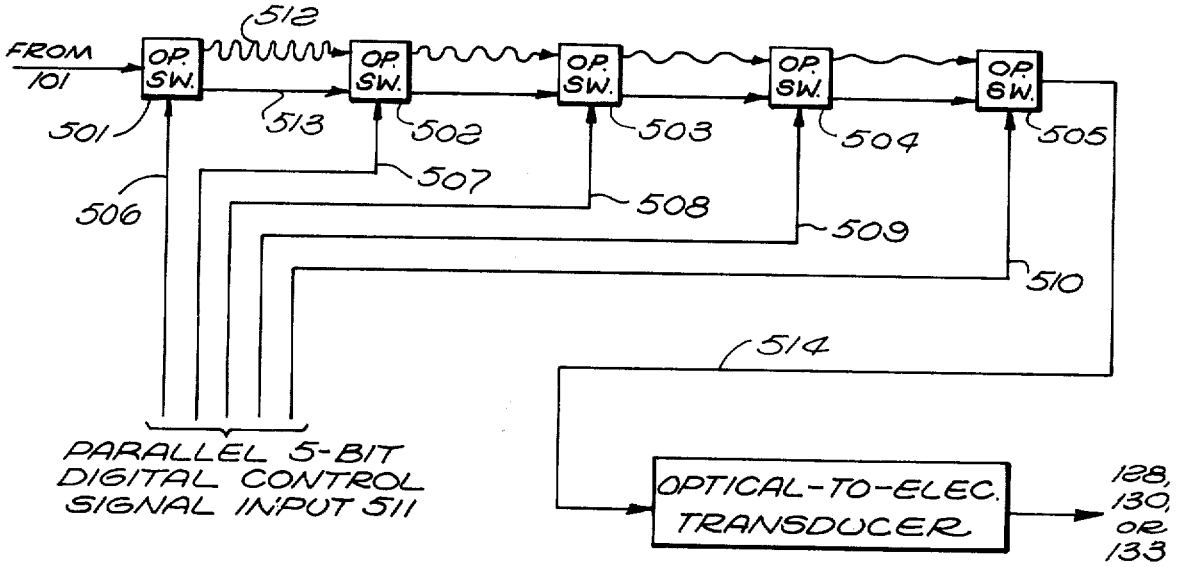
FIG. 5.

FIBER OPTIC PHASED ARRAY ANTENNA SYSTEM FOR RF TRANSMISSION

BACKGROUND OF THE INVENTION

1. FIELD OF THE INVENTION

The invention relates to control of phased array systems generally and more particularly to means for generating multi-phased radio frequency signals for such arrays.

2. DESCRIPTION OF THE PRIOR ART

The prior art in respect to phased array antennas and the technique for generating the required multi-phase excitation signals in controllable fashion, are extensively described in the technical literature. The text "Phased Array Antennas" by Oliver and Knittel (proceedings of the 1970 Phased Array Antenna Symposium) provides a good prior art insight into the general design of phased arrays, the requirements for excitation, and the limitations encountered. That text was published by Artech House, Inc., Dedham, Mass., and is further identified by Library of Congress Catalog Card No. 73-189392.

In addition, the text "Radar Handbook" by Merrill I. Skolnik, (McGraw Hill 1970) also provides considerable insight and background information in respect to the design of phased array systems.

In general, a phased array, which provides maximum scanning flexibility and random, inertialess, beam-pointing capability, involves the individual excitation of the radiating elements of the arrays, or at least individual rows or columns of elements treated discretely in respect to the phase of the RF excitation thereof. In some of the most advanced and most flexible phased array systems, two-dimensional arrays, such as planar arrays, are used which require individual excitation of all or substantially all of the elements in order to provide a pencil-beam with pointing flexibilty desired throughout a solid angle of coverage.

What may be referred to as the classical approach to the problem involves the use of controllable individual radio frequency phase shifters between the source of transmittable RF, and each of the aforementioned array radiating elements (antenna elements). chapter 12 of the aforementioned Radar Handbook reference describes known types of controllable phase shifters available for the purpose. These include the so-called ferrite phase shifters, and those employing semiconductor diodes. The former can provide either stepped or continuously variable phase shift within recognized limits in response to a digital or analog type control signal, whereas the latter generally provide phase shift in discrete steps (usually digitally controlled). The manner of digital or analog control is explained in the text aforementioned.

"Random" beam pointing arrays have been constructed employing these techniques, however, the result has been very expensive apparatus of large size and considerable weight. Because of that fact, there has been considerable incentive for the development of simplifications to reduce the size and complexity of phased array control systems.

Not only have the prior art systems required the provision of large numbers of phase shifters (on a one-for-one basis to the array elements), but these devices and their driving circuitry have been relatively complex sub-systems of themselves.

For example, in the aforementioned Radar Handbook, Chapter 12, digital and analog latching phase shifter driver circuitry is shown. In addition to the complexity problem, relatively large amounts of electric power are required for the programmed operation of the prior art phased array scanning and beam pointing systems employing those approaches.

Still further, the prior art systems of the type very often do not provide phase placements for the individual elements of the array sufficiently accurate to provide uniform beam shape over a full range of beam pointing angles (scan angles).

The optical delay lines employed are preferably relatively inexpensive predetermined lengths of fiber optic cable, or single glass strands of that type. The art in respect to such light transmissive optical fibers is summarized and explained in an article entitled "Fiber Optic Communications: A Survey" by C. P. Sandbank, appearing in "Electrical Communication," Volume 50, Number 1, 1975, a technical journal published by International Telephone and Telegraph Corporation.

The manner in which the present invention deals with the disadvantages of prior art systems of the type to provide a novel and highly advantageous combination, which is relatively low in cost, size and weight, will be understood as this description proceeds.

SUMMARY OF THE INVENTION

The invention in its most basic form involves apparatus for producing a phase-shifted (delayed) radio frequency signal for each antenna element by imposing said signal on an optical frequency carrier, passing the modulating carrier through an optical delay line, and demodulating to provide the desired phase-shifted signal.

If the optical delay line has an electrically selectable (controllable) length, the phase shift of the RF signal may be selected or controlled in accordance with a programmed control signal.

Still further, a plurality of controllable optical delay lines, each with its own demodulator and each separately programmable, provides the necessary plural, programmed, discretely phase-shifted signals for the excitation of the radiating elements (antenna elements) of an array, for controlling the beam pointing position of a radiation lobe in at least one plane generated by such an array.

The aforementioned article entitled "Fiber Optic Communications: A Survey," in the said Electrical Communication Periodical, points out that even optical glass fibers as small in diameter as a human hair are known to provide signal transmission with very little attenuation. The reference reviews the state of the art in respect to these fiber materials and also treats the subject of transmittable light sources, light-beam modulation means, and appropriate demodulation devices.

In the combination of the present invention, switching of light signals among plural optical fibers each corresponding to a discret phase delay required for excitation of any given corresponding antenna radiating element at some beam angle, is employed. Accordingly, the programming of the duplicated optical delay line and detection hardward for each radiating element is a matter of predetermined commutating sequence only, and does not involve complex logic.

The detailed manner in which the present invention may be instrumented is described in respect to two typical, respresentative embodiments in the description hereinafter.

BRIEF DESCRIPTION OF THE DRAWINGS

FIG. 3 depicts the nature of the multi-channel fiber optic delay lines employed in both FIGS. 1 and 2.

FIG. 4 is a detail of the switchable optical-to-RF transducers employed in the system of FIG. 1.

FIG. 5 is an alternate subcombination for digitally controlled selection of the fiber optic delay line in lieu of apparatus included in FIGS. 1 and 2 for phase delay control.

DESCRIPTION OF THE PREFERRED EMBODIMENTS

Figure 1:
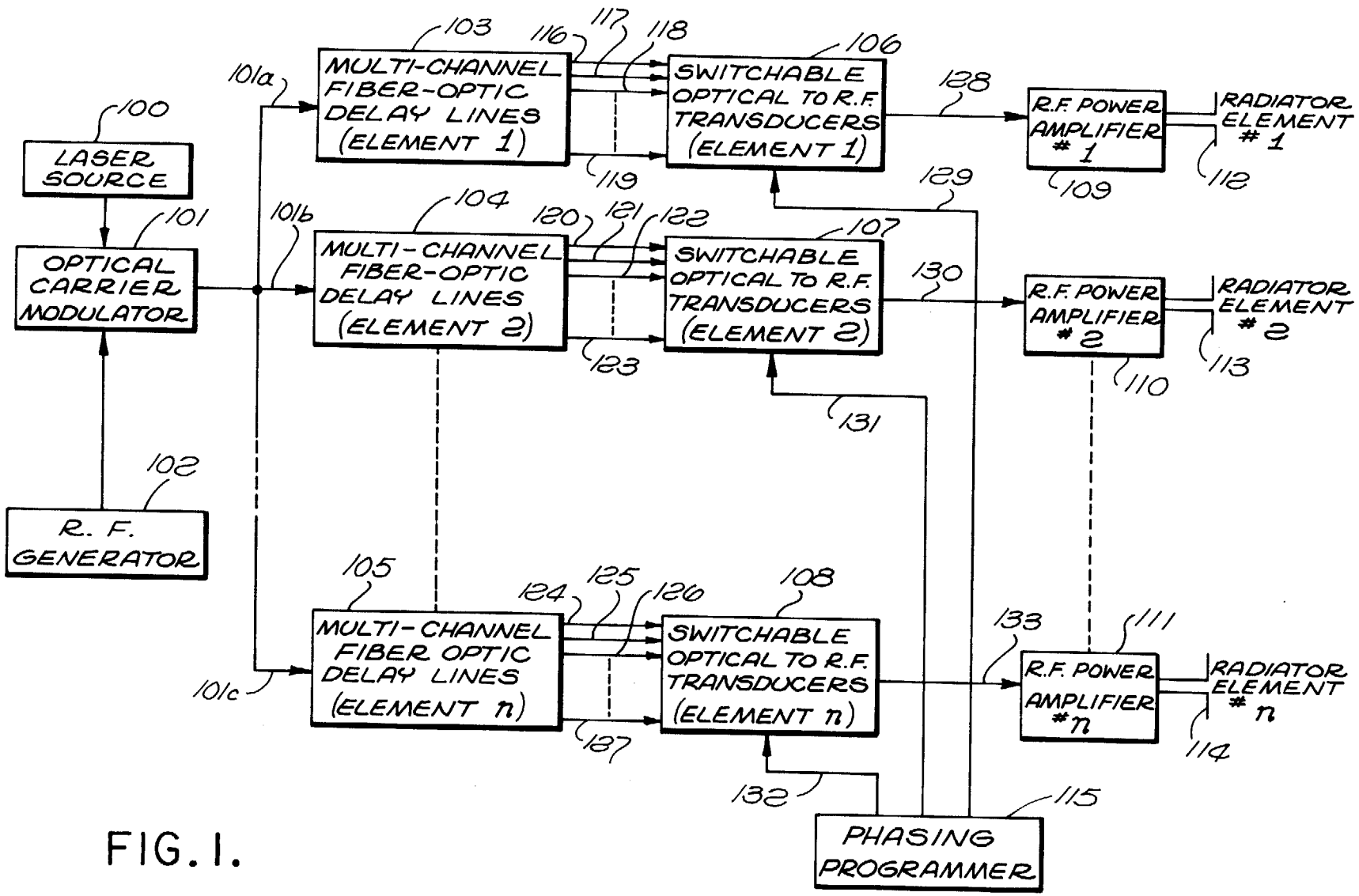
FIG. 1 is a schematic block diagram of a system in accordance with the present invention, in which phase delay switching is effected after the optical-to-RF transducers.

Referring now to FIG. 1, a first embodiment will be described.

A laser generator 100 is illustrated as a CW source of optical frequency (light) energy. Optical carrier modulator 101 responds to the CW RF signal from generator 102 to amplitude (intensity) modulate the laser beam from 100. Thus, an output from 101 is obtained which is a light energy signal so modulated. It will be understood at this description proceeds, that neither modulation efficiency nor depth of modulation achieved in 101 is particularly important. Since the modulation is a fixed frequency situation, the modulator function may be carried out over a very limited bandwidth embracing little more than the fixed frequency of RF generator 102. A laser source 100 is contemplated as a light energy source because the high light intensity provided is still substantial when the modulated light signal from 101 is divided optically among what may be a substantial plurality of multi-channel delay line arrangements, i.e., typically 103, 104 and 105, etc. Ordinary beam splitting techniques, as are well known in the optical arts, are employed in providing a modulated energy input for each of these delay line units from the output of 101.

As depicted on FIG. 1, the leads 101*a*, 101*b* and 101*c* are actually plural leads in themselves. This to be understood from looking ahead to FIG. 3, which represents any of the multi-channel fiber optic delay lines such as 103, 104 or 105. Each of the blocks 103, 104 and 105 discretely corresponds to a radiating element of the array to be controlled, these being identified as element 1, element 2 and element *n*, respectively. It will be realized of course, that FIG. 1, and, for that matter, FIG. 2 (yet to be described) are simplified in that ordinarily there would be many more elements in the array and consequently many more blocks, as depicted in FIG. 3, existing between 104 and 105. In FIG. 3, a simplification has been also made, in that only four lengths of fiber optic conductors are depicted, thus, for illustration, four discrete values of phase delay are achievable through the device of FIG. 3; although here again, in a practical situation, a much larger plurality of discrete delay values would ordinarily be required.

To take a purely arbitrary example illustrating that fact, let it be supposed that the phased array were constructed to scan over a 45° sector (or to assume beam-pointing positions discretely within such a sector) and that the beam positioning granularity desired was 1/10°. Since this amounts to 450 discrete beam angles within the aforementioned 45° sector, each antenna element would be excited by 450 different RF phase values. In accordance with that element, it will be seen that the device of FIG. 3 would be necessarily comprise 450 discrete fiber optic lines.

Of course, there are many practical phase array systems requiring far fewer discrete excitation phases in a practical scan program, however, even with a relatively large number of discrete excitation phases required, the device of FIG. 3 in accordance with present fiber optic technology is still a relatively simple and inexpensive device. This is true, because the individual optical delay lines may be constructed from a coiled length of fiber optic conductor as small in diameter as a human hair and nearly as flexible.

In view of the relatively low light attenuation afforded by fiber optic conductors of the type employed, even a relatively long individual line (which affords a delay per unit length at least 20% greater than air) is readily provided.

To provide a feeling for the quantitative order of physical delays to be dealt with in the fiber optic delay lines, it is noted that 90° of electrical phase shift at 100 MHz amounts to only 0.005 microseconds of delay.

Figure 2:
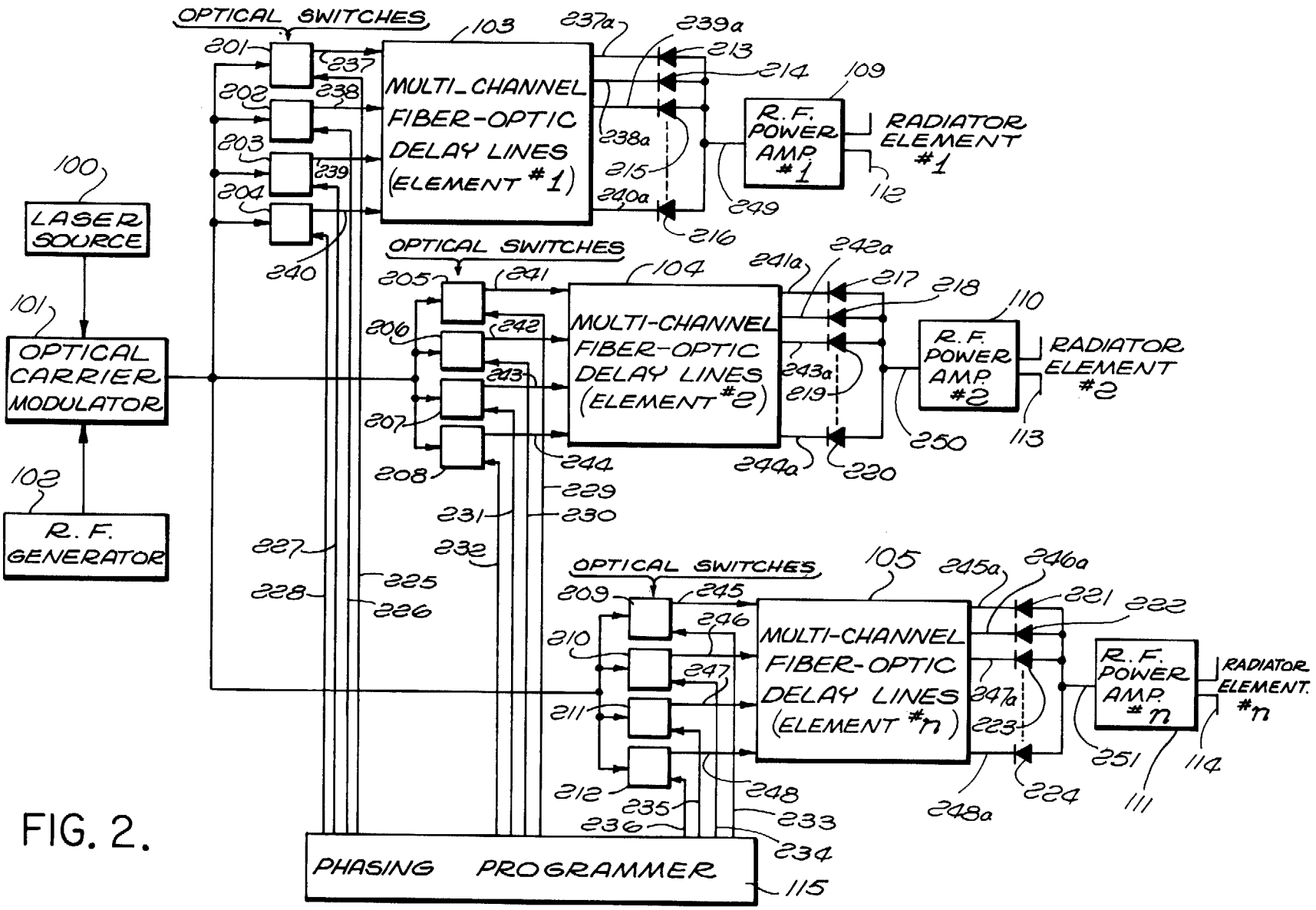
FIG. 2 is a schematic block diagram depicting a system in accordance with the present invention in which the optical fiber switching for controlling the phase delay produced is effected ahead of the fiber optic delay lines.

Although the identification numbers provided on FIG. 3 at the inputs are as related to FIG. 2, suffice it to say in connection with FIG. 1 that the inputs are driven in parallel at substantially equal intensities from 101, applying the known beam-splitting techniques as aforementioned.

The outputs of the device of FIG. 3 are, however, identified for both FIGS. 1 and 2 and are readily correlated therewith by inspection.

Returning now to FIG. 1, each of the delay line assemblies 103, 104 and 105 will be seen to provide its plural outputs to corresponding switchable optical-to-RF transducer devices 106, 107 and 108, respectively.

It will be realized that each output of 103, 104 and 105, namely, the leads 116, 117, 118 and 119 from block 103; 120, 121, 122 and 123 from block 104; and 124, 125, 126 and 127 from block 105 contains a continuous modulated light signal which has passed thorugh the corresponding fiber optic conductor internally (see 301, 302, 303 and 304 on FIG. 3).

To proceed with the description, it is necessary also to refer to FIG. 4 which illustrates a typical configuration of blocks 106, 107 and 108. Here photo-diodes 401, 402, 403 and 404 receive the inputs to the one of these blocks, as indicated. Each of these photo-diodes is back-biased selectively through isolating resistors 405, 406, 407 and 408, respectively. The phasing programmer 115, which is simply a commutator device (ordinarily of an electronic type) which "turns on" one of the photo-diodes in each of the transducers 106, 107 and 108, in a pre-arranged pattern, by alternating the bias on one of the resistors 405 through 408, as illustrated in FIG. 4. Stated otherwise, it may be said that the photo diodes 401 through 404, are selectively gated on, one at a time, in the predetermined commutating program from 115. The arrangement is such that only one photo diode in each of the transducer blocks 106 through 108 is permitted to demodulate the light signal at its corresponding input, thereby passing the RF modulation as an output signal through one of the corresponding capacitors 409, 410, 411 or 412. Accordingly, each of the leads 128, 130 and 133 contains an RF signal corresponding to the appropriate phase for excitation of the corresponding antenna element at any given time so that the array can produce the antenna beam pointing angle corresponding thereto. Each of the output leads 129, 131 and 132 from the phasing programmer 115 is thus understood to comprise all the leads to the isolating resistors in the corresponding block 106, 107 or 108, with only one of these plural leads carrying on "on-control" signal to a photo diode in each optical-to-RF transducer block at any time. It will also be seen from FIGS. 1 and 4 that the output leads 128, 130 and 133 are the respective collected outputs from each of those transducers 106, 107 or 108, as illustrated.

In accordance with the foregoing, the demodulated light signal on leads 128, 130 and 133 is the ratio frequency modulation, appropriately phase shifted according to the dictates of the programmer 115, albeit at a relatively low power level. Accordingly, corresponding RF power amplifiers 109, 110 and 111 are provided to suitable power amplify those signals for the excitation of the corresponding radiating elements 112, 113 and 114, the first, second and *n*th antenna elements, respectively.

The embodiment of FIG. 1 may be though of as involving selection of the optical delay at the fiber optic line outputs, whereas the embodiment of FIG. 2 will be seen to involve pre-selection of the optical delay line within each of the blocks 103, 104 and 105, which is to be employed at any one time.

Concerning the various ways of instrumenting the individual blocks of the present invention, it is noted that, while discrete optical modulators are extant in the art for accomplishing the function of block 101, there are also some known varieties of laser beam generators similarly extant at the current state of the art, which are particularly adaptable to direct modulation of the intensity of the output beam by varying a parameter thereof. Such an expedient may be thought of as an alternative for the production of the RF modulated beam. Such direct generation of the RF modulated beam may be relatively attractive at some operating frequencies in view of the fact that the depth of modulation required for satisfactory operation of the combination of the present invention need not be particularly great. An example of the use of a discrete modulator, such as illustrated at 101, is the so-called electrooptic crystal device variously described in the prior art literature including Chapter 37 of the aforementioned "Radar Handbook" reference text.

The photo-diodes illustrated at 401 through 404 in FIG. 4 may actually be more broadly described as optical-to-RF transduce elements, gnerally embracing photo-emissive detectors, and photo conductive devices as well as photo-diodes, the specific selection depending upon design considerations, such as frequencies of modulation, etc. PIN junction photo diodes are known to be capable of frequency responses in the microwave region, at least up to 10 GHz.

Each of the RF amplifiers directly feeding the individual elements of the phased array may provide a relatively large amount of total array radiated power, speaking collectively. The individual power required at each radiating element may be relatively modest however, and readily obtained with known relatively simple and inexpensive solid state microwave amplifying devices.

As has been previously indicated, the phasing programmer 115 requires no complex logic and is actually nothing more than a ganged commutator or electronic switch device for selecting the proper RF phase delay for each radiating element for each descrete beam pointing position. It is conceivable, that such a device could be implemented even with electromechancal commutating means in view of its relatively simple and straightforward function, however, the exploitation of the inherent capability for inertialess scan and beam pointing using phased arrays can only be exploited appropriately with electronic switching techniques.

Referring now to FIG. 2, a second embodiment will be described. The laser source 100, modulator 101 and an RF generator 102 may be identical to those described in connection with FIG. 1, and the same applies to the multi-channel fiber optic delay line blocks 103, 104 and 105. In FIG. 2 however, an optical switch is supplied ahead of the delay lines for each discrete fiber delay line in each of the blocks 103, 104 and 105. Thus, controllable optical switches 201, 202, 203 and 204 apply respectively to inputs 237, 238, 239 and 240 of block 103. Similarly, switches 205, 206, 207 and 208 switch input leads 241, 242, 243 and 244 to block 104. Still further, switches 209, 210, 211 and 212 switch in series with input leads 245, 246, 247 and 248, respectively, to block 105. FIG. 3 correlates these leads with the four fiber optic lines 301, 302, 303 and 304, of arbitrarily illustrated lengths (delays). All of these optical switches are connected together to the modulated optical signal at their inputs (fed from the modulator 101) through well understood beam splitting techniques, as was the case in the embodiment of FIG. 1. Each of these optical switches 201 through 212 is an on-off device controlled by an electrical signal.

Such optical switches are known in the prior art in various forms. One such device makes use of an electro-optic crystal with the electrical control signal applied by means of transparent electrodes on the crystal faces. The birefringence phenomenon is relied upon to produce a light polarization modification. In combination with a fixed optical polarizer, such a switch can be made to either turn on, i.e., pass the optical signal, or turn off (inhibit the optical signal) in response to the electrical control signal for each of the optcial switches 201 through 204 associated with 103. The respective control signals for this function are provided by the phasing programmer on 225, 226, 227 and 228. For the optical switches 205 through 208 applicable to 104, the respective control signals are provided by the programmer on leads 229, 230, 231 and 232. Finally, optical switches 209 through 212 (at the inputs of 105) are controlled from programmer 115 via signals of the same described type on leads 233, 234, 235 and 236.

The programming of the control signals for these optical switches is identical to that required in connection with FIG. 1, i.e., only a simple ganged commutation arrangment is required for energizing one selected switch feeding each of the fiber optic delay line blocks 103, 104 and 105 at any one time, corresponding to any one beam pointing angle.

The outputs of blocks 103, 104 and 105 on FIG. 2 show, as indicated and correlated on FIG. 3, that there is one output for each input. On FIG. 2 these outputs are labeled with the appendix (a) affixed to the same number applied to the respective input, it being understood therefrom that the input and output of a discrete fiber optic line is thereby identified.

Unlike the arrangement of FIG. 1, these delay line block output lines carry a light output signal only one at a time, and accordingly, a simple photo diode (or one of the alternatives aforementioned in connection with FIG. 1) serves to demodulate whichever optic delay line carries the light energy signal at any one time. These diodes are output paralleled for mixing the outputs together at the input to the RF power amplifier corresponding to each of the delay line blocks. Thus, the light demodulating transducers 213, 214, 215 and 216 have a common output 49 to RF amplifier 109 associated with radiator element 112 also identified as the No. 1 antenna element. Similarly, 217, 218, 219 and 220 discretely and individually contribute an output to line 250 for input to RF power amplifier 110 associated with 113, i.e., radiating element number 2 for the 2nd radiating element 113 driven by the 2nd RF power amplifier 111, the outputs of detectors 221, 222, 223 and 224 are assembled at lead 251 to provide the input to 111, and thereafter to drive the nth radiator 114.

In FIG. 2 the result in respect to programming the individual RF phases at the radiating elements of the array is substantially identical to the result obtained in arrangements of FIG. 1, the difference between these two embodiments being the relationship of the switching function and components to the optical delay lines, which will now be well understood.

Referrin now to FIG. 5, an additional embodiment of the optical delay lines switching arrangment is depicted. This emboidment would take the place, for example, of the optical switches and optical delay line block associated with each radiating element as depicted in FIG. 2, for example. FIG. 5 contemplates the use of a controlled signal in parallel digital form. A five-bit digit control signal has been assumed for the sake of explanation, however it will be understood that in a practical arrangement, the digital control signal would employ the required number of bits to represent the full range of discrete beam positions consistent with the predetermined scan or beam pointing granularity desired.

In FIG. 5, as in FIG. 2, a plurality of electrically controlled optical switches are employed, illustrated at 501, 502, 504 and 505 in the particular example. If these switches are of the birefringent crystal and polarizer type aforementioned, the structure may be duplicated, i.e., made into essentially two switches at each position 501 through 505 in order to provide the single-pole-double-throw effect desired. Alternatively, the output of the birefringent crystal might be separated on a polarization basis by beam splitting techniques and separate fixed polarizers producing an integral single-pole-double-throw switch. The digital input signal at 511 includes the most significant digit, applied at 506, the next most significant at 507, and so on through 508 and 509, down to the least significant digit applied at 510. Each switch either diverts the optical signal through the length of fiber optic delay line following it or through a path constituting an optical "short circuit" to the next switch. Thus, for a 1 condition of the most significant digit lead 506 the output of 501 would be diverted or fed to 502 through the optical delay line 512, which has a predetermined delay consistent with the value of this most significant digit. In the 0 condition at 506, the signal from 501 reaches 502 via the optical "short circuit" 513. The identical process applies to each of the remaining digits in the control code word and hence, the output on 514 is delayed in accordance with the sum of the values of the 1 digits applied at 511. For the same antenna parameters and other design considerations, the range of RF phase delays obtained at the output of the optical-to-electric transducer 515 in response to the delayed light energy signal on 514 may be substantially identical to that provided at each given RF power amplifier feeding a corresponding radiator in either FIG. 1 or FIG. 2. The output of 515 would be applied to the corresponding one of said RF power amplifiers as indicated.

It will of course be realized by those skilled in the art that a number of modifications and variations are possible in respect to the specific instrumentation of a device in accordance with the principles of the present invention, such variations might include such expedients as inclusion of AND circuit logic into FIG. 4 rather than the back-biasing technique illustrated. Other light sources than the suggested laser source 100 might also be applied, since fundamentally the system of the invention is capable of being operated with relatively low individual light levels in the optical delay lines. More advanced control logic can also be applied, if desired, to other parts of the combination.

It will also be realized that the rate of scan or beam positioning is an independent variable determined by the speed of operation of 115, or the predetermined program speed of a digital computer supplying the control code at 511. These considerations also apply to beam positioning on a random basis. For a uniformly progressing scan, a ramp control function driving amplitude quantizers may be included in 115.

Of course, it is not necessary that the optical delay lines be restricted to a single optic fiber strand, however, there would appear to be no incentive for making those elements any larger, heavier or more costly than necessary to fulfill their function.

Other variations and modifications will obviously suggest themselves to those skilled in this art and accordingly, it is not intended that the scope of the present invention should be considered to be limited to the embodiments illustrated and described, the drawings and this description being intended as typical and illustrative only.

What is claimed is:

1. In a radar system including a plural element antenna array at least some elements of which are individually phase-controlled for forming a relatively narrow beam directive in at least one plane, the combination associated with at least one of said phase-controlled antenna elements comprising:

first means including a radio frequency generator for producing a signal at the RF frequency of operation of said system;

second means comprising a source providing a light energy output;

third means including a modulator connected for modulating said light energy source with the output of said radio frequency generator;

fourth means responsive to the modulated light output of said third means, including a plurality of optical delay lines driven in parallel from said third means, said optical delay lines each having a physical length for producing a discrete phase delay required to excite a corresponding one of said elements according to a predetermined phasing program;

fifth means operatively associated with said fourth means, for selecting a signal as an output, said selected signal passing through a predetermined one of said optical delay lines to provide a signal having said discrete phase delay;

and sixth means responsive to said fifth means for demodulating said light signals and for providing an RF output signal to said corresponding array element.

2. Apparatus according to claim 1 in which said fourth, fifth and sixth means are provided for each of said phase-controllable elements, and phasing programming means are provided to discretely control said fifth means corresponding to each of said controllable elements to produce phases of antenna element excitation required to develop said directive beam.

3. Apparatus according to claim 2 further defined in that each of said fourth means comprises a plurality of said optical delay lines, each of said lines corresponding to a discrete phase delay required at the corresponding antenna element for a predetermined angular position of said directive beam, said phase programming means controlling each of said fourth means to provide the required element phase for said angular beam position.

4. Apparatus according to claim 3 in which said programmming means provides a program of control signals to each of said fourth means such that each antenna element phase is successively provided to effect a programmed succession of beam positions, thereby to produce scanning of said beam.

5. Apparatus according to claim 3 in which said fifth means comprises a plurality of photo diodes, one of said diodes being responsive to the output of each of said optical delay lines, and said programmer is connected to control a selected one of said diodes to pass the modulated light signal from only a predetermined one of said delay lines at only one time to said sixth means, said photo diodes also performing the demodulation function of said sixth means.

6. Apparatus according to claim 3 in which said fifth means comprises a plurality of discrete optical gating devices connected to said parallel drive of said fourth means from said third means, in which said programmer is connected to control a selected one of said gating devices to pass the modulated light signal from only a predetermined one of said delay lines at any one time to said sixth means, and in which said sixth means comprises means for demodulating light signals passed through each of the plurality of optical delay lines corresponding to each one of said antenna elements.

7. Apparatus according to claim 1 in which said second means comprises a laser beam generator.

8. Apparatus according to claim 1 in which said optical delay lines are predetermined lengths of fiber optic cable.

9. Apparatus according to claim 1 in which said sixth means comprises RF power amplification means to increase the relatively low level of RF power provided by demodulation of RF modulated light beams.

* * * * *